US007234685B2

(12) United States Patent
Britten

(10) Patent No.: US 7,234,685 B2
(45) Date of Patent: Jun. 26, 2007

(54) APPARATUS FOR RAISING AND LOWERING A BANNER

(76) Inventor: Paul J. Britten, 4000 Incochee Crest, Traverse City, MI (US) 49684

( * ) Notice: Subject to any disclaimer, the term of this patent is extended or adjusted under 35 U.S.C. 154(b) by 148 days.

(21) Appl. No.: 11/013,096

(22) Filed: Dec. 15, 2004

(65) Prior Publication Data

US 2006/0208246 A1 Sep. 21, 2006

(51) Int. Cl.
*B66F 1/00* (2006.01)

(52) U.S. Cl. ..... 254/385

(58) Field of Classification Search ..... 254/335, 254/336, 362, 385, 386, 278; 242/157 R, 242/157.1

See application file for complete search history.

(56) References Cited

U.S. PATENT DOCUMENTS 410,507 A * 9/1889 Fain ..... 254/278
1,941,250 A * 12/1933 Dale ..... 242/157.1
2,984,455 A * 5/1961 Fischer ..... 254/274
3,144,998 A * 8/1964 Back ..... 242/157.1
3,228,616 A * 1/1966 Grosh ..... 242/437
3,711,035 A * 1/1973 Tatum et al. ..... 242/447.3
3,815,846 A * 6/1974 Biewer ..... 242/478.2
3,866,718 A * 2/1975 Hiergeist ..... 187/262
4,434,570 A 3/1984 Roos et al.
4,767,073 A * 8/1988 Malzacher ..... 242/414
6,105,938 A * 8/2000 Koida ..... 254/278
6,435,447 B1 * 8/2002 Coats et al. ..... 242/483
6,443,431 B1 * 9/2002 Stasny et al. ..... 254/385
6,969,049 B2 * 11/2005 Bilcik ..... 254/278

FOREIGN PATENT DOCUMENTS

FR 2 828 322 A 2/2003
WO WO 01/34513 5/2001

* cited by examiner

*Primary Examiner*—Emmanuel M Marcelo
(74) *Attorney, Agent, or Firm*—Harness, Dickey & Pierce P.L.C.

(57) ABSTRACT

An apparatus for raising and lowering an article includes a tube, a motor coupled to the tube for rotating the tube, a plurality of cables secured to the tube and to the article in spaced relation to each other, and a cable indexer synchronously coupled with the tube for indexing the plurality of cables along the tube as the plurality of cables are wound on the tube to wind the plurality of cables on the tube uniformly with respect to each other.

14 Claims, 7 Drawing Sheets

APPARATUS FOR RAISING AND LOWERING A BANNER

FIELD OF THE INVENTION

The present invention relates to display articles, such as banners, that are hung from high places, such as ceilings in malls, and more particularly, to an apparatus for raising and lowering a display article.

BACKGROUND OF THE INVENTION

Banners, posters or other types of display articles are used for textual and/or graphical displays. They are hung in a variety of different places and locations. In one type of application, the display article is hung from a high location, such as the ceiling of a mall or other large facility. In this application, the display article is typically hung using a ladder, cherry picker or other type of lift that is used to raise the display article to the appropriate height where it is then affixed to an element of the facility, such as a cross-beam of a ceiling. When the display article is changed, the same process is used. That is, a ladder, cherry picker or other type of lift is used to access the hung display article, remove it, and then affix the new display article in place.

SUMMARY OF THE INVENTION

An apparatus for raising and lowering an article in accordance with the invention includes a tube, a motor coupled to the tube for rotating the tube, a plurality of cables secured to the tube and to the article in spaced relation to each other, and a cable indexer synchronously coupled with the tube for indexing the plurality of cables along the tube as the plurality of cables are wound on the tube to wind the plurality of cables on the tube uniformly with respect to each other. In an aspect of the invention, the cable indexer includes a traveler having an aperture for each of the plurality of cables. The traveler is mounted in spaced relation to the tube for movement along an axis parallel to a longitudinal axis of the tube as the tube rotates to move each of the plurality of cables longitudinally along the tube as the tube rotates.

In an aspect of the invention, the cable indexer includes a lead screw mounted in spaced relation to the tube and synchronously coupled to the tube for rotation synchronously with the tube as the tube rotates. The traveler includes a threaded member through which the lead screw is threadably received.

In an aspect of the invention, the cable indexer includes a traveler for each of the plurality of cables.

In an aspect of the invention, a drive wheel having teeth thereon is affixed to the tube, a driven wheel having teeth thereon is affixed to the lead screw, and a belt having teeth on an inner surface is entrained on the drive wheel and driven wheel. The drive wheel, driven wheel and belt synchronously couple the lead screw to the tube.

In an aspect of the invention, the motor is a tubular motor having a motor with a tube extending therefrom that is received within the tube on which the cables are wound.

In aspect of the invention, the motor is coupled to a remote control receiver that controls the motor in response to signals received from a remote control transmitter.

In an aspect of the invention, the apparatus includes a programmable device coupled to the motor that controls operation of the motor in response to its programming.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses.

Figure 1:
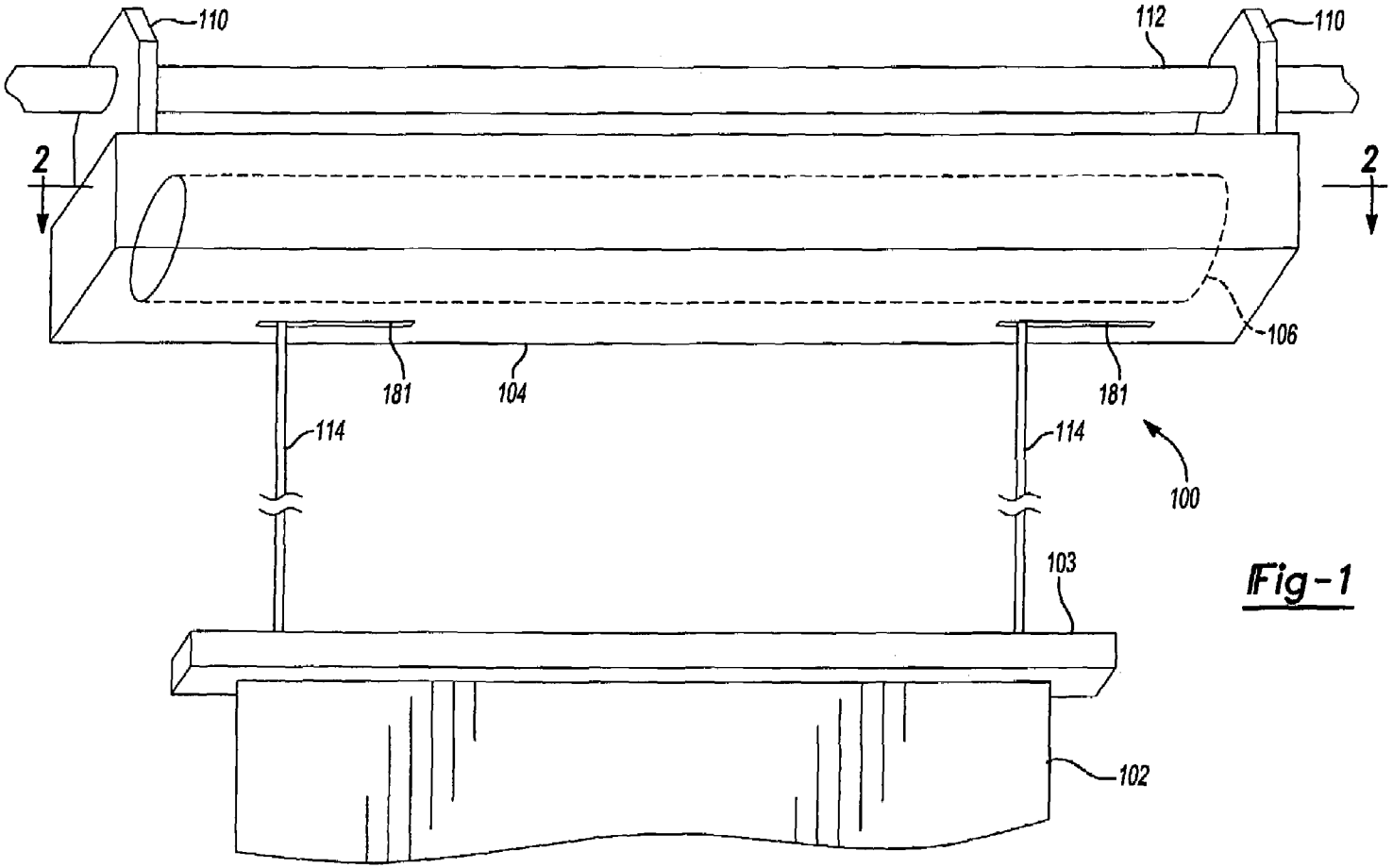
FIG. 1 is a perspective view of an apparatus in accordance with the invention for raising and lowering a display article.
Figure 2:
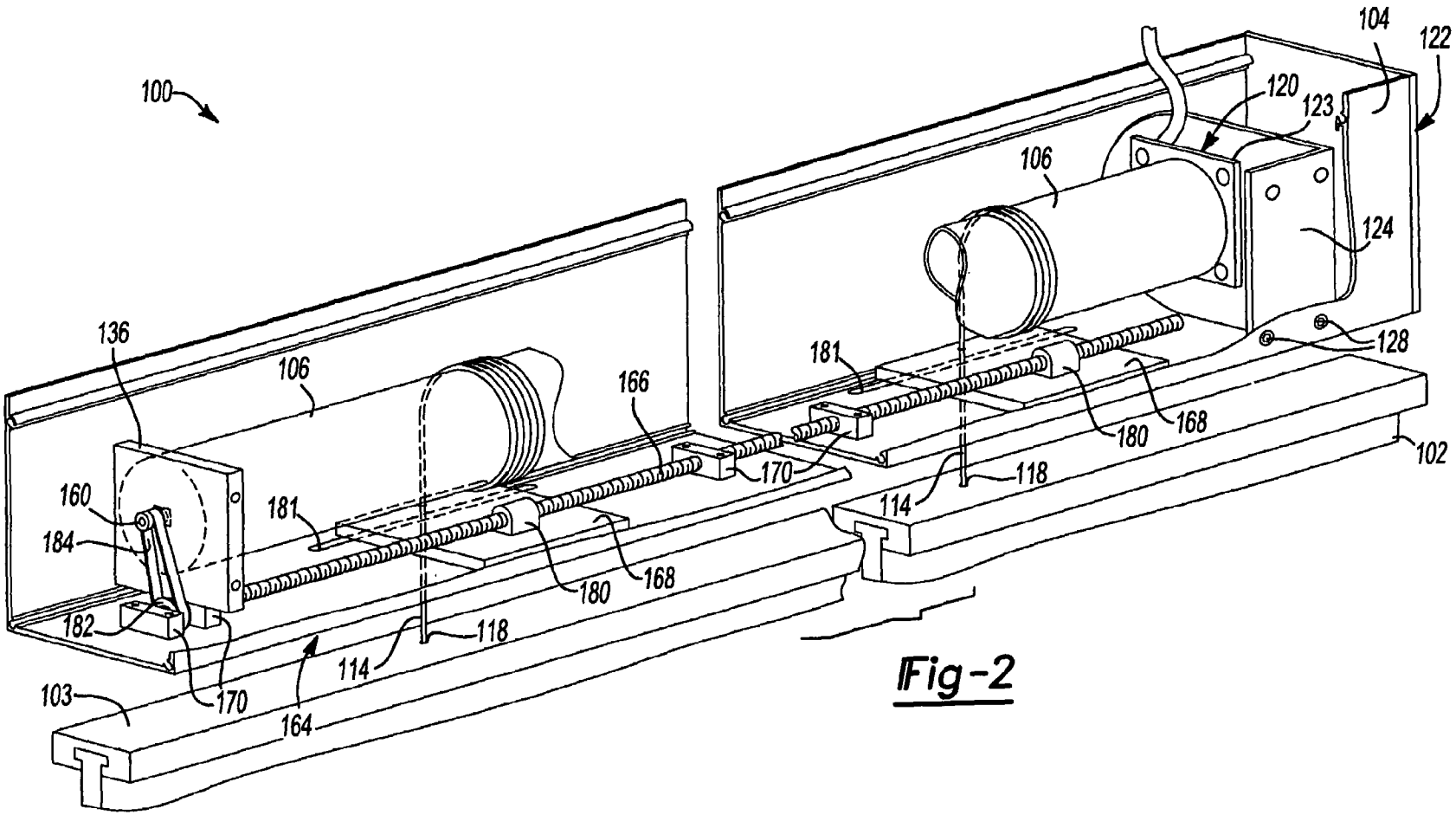
FIG. 2 is a side perspective view, partially broken away, of the apparatus of FIG. 1 taken along the line 2-2 of FIG. 1.

Referring to FIG. 1, an apparatus 100 for raising and lowering a display article 102 is shown. Display article 102 can be any type of article that is hung for display, such as banners. With reference to FIGS. 1 and 2, apparatus 100 includes a housing 104, which is illustratively a longitudinally extending channel having a rectangular cross-section, and tube 106. Apparatus 100 may also include mounting brackets 110 which attach to an element 112 of the structure to which apparatus 100 is mounted, such as a rod or beam of a ceiling of a facility such as a shopping mall (not shown). It should be understood that apparatus 100 can be attached to the element 112 in other ways than by mounting brackets 110.

Apparatus 100 further includes one or more lengths of string or cable 114 (which will be collectively referred to as cable 114 herein) having one end 116 (FIG. 8) secured to tube 106. A top edge 103 of display article 102 is secured to the other end 118 of cable 114 (FIG. 2). In the embodiment of apparatus 100 shown in the drawings, apparatus 100 includes two lengths of cable 114 secured to tube 106 in spaced relation to each other. Illustratively, the two lengths of cable 114 are preferably spaced from each other a distance that is about equal to or slightly less than the width of the display article 102. It should be understood, however, that apparatus 100 could have other than two lengths of cable 114. Where more than two lengths of cable 114 are used, the lengths of cable 114 may illustratively be spaced equidistantly from each other within the width of the display article. As used herein, the width of the display article 102 is the width of top edge 103 of display article 102 to which cable(s) 114 are attached.

Figure 4:
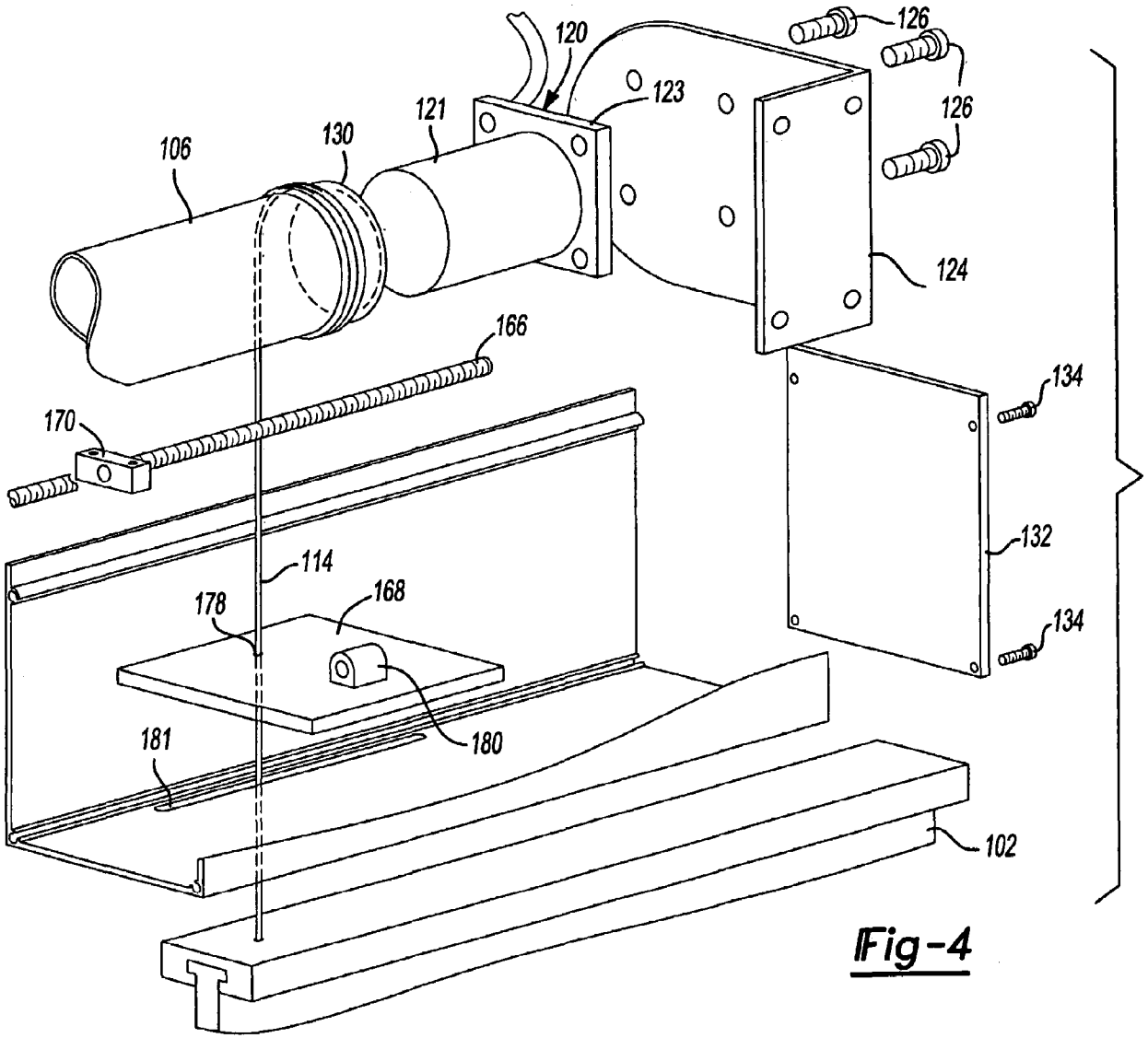
FIG. 4 is a partial exploded view of a second end of the apparatus of FIG. 1.
Figure 5:
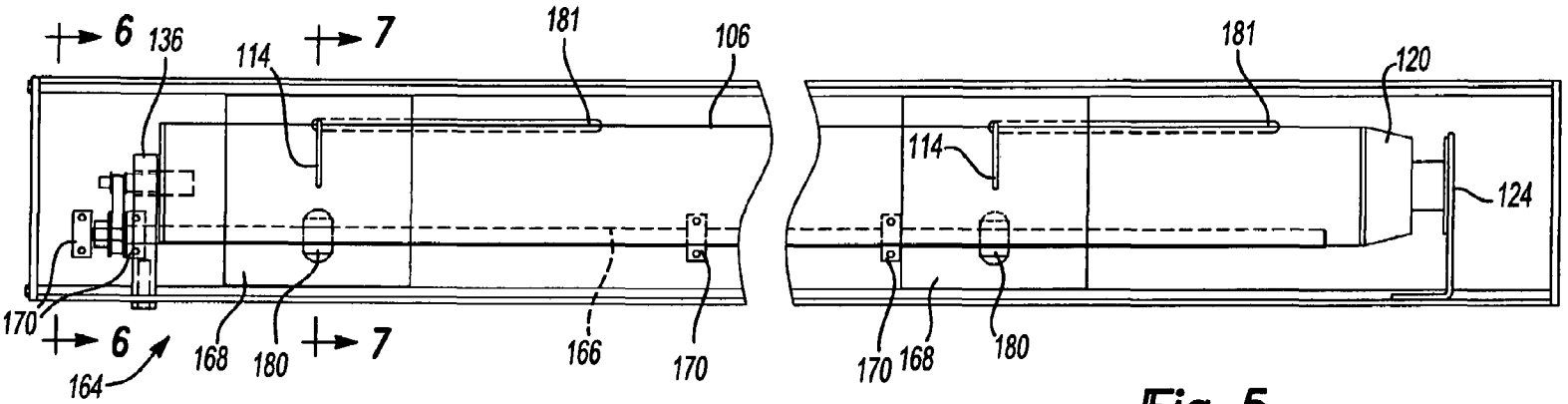
FIG. 5 is a top perspective view of the apparatus of FIG. 1.
Figure 7:
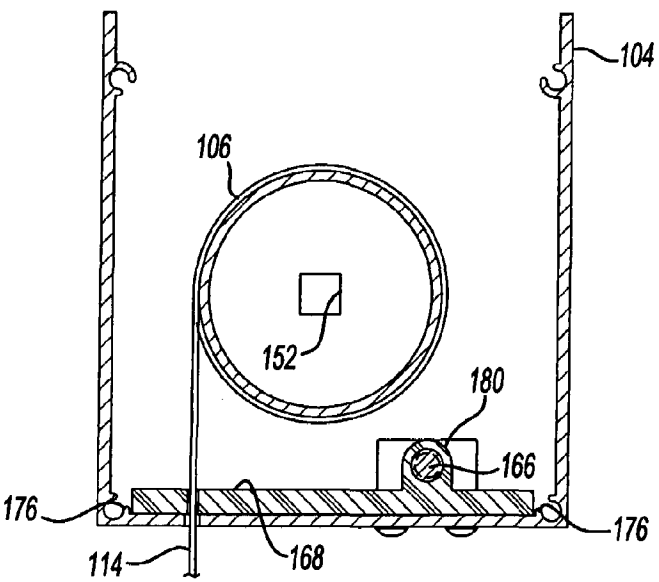
FIG. 7 is a section view taken along the line 7-7 of FIG. 5.
Figure 6:
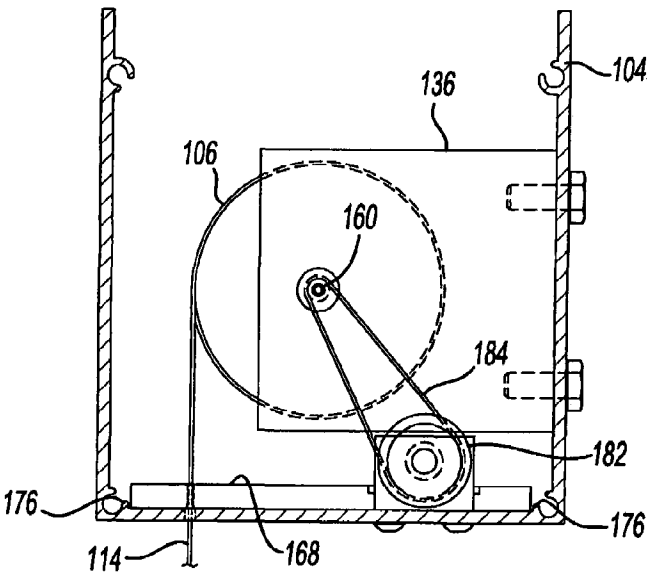
FIG. 6 is a section view taken along the line 6-6 of FIG. 5.

With specific reference to FIG. 4, apparatus 100 also includes a motor 120 to which tube 106 is coupled. Motor 120 is illustratively mounted in housing 104 at a first end 122 (FIG. 2) of housing 104 by attachment to mounting bracket 124, such as with screws 126. Motor 120 may illustratively be a tubular motor, such as a SOMFY LT tubular motor available from SOMFY Systems, 47 Commerce Drive, Cranbury, N.J. 08512. Motor 120 would in such event include a motor 123 to which a tube 121 is attached that fits within a first end 130 of tube 106 and to which tube 106 is secured in conventional fashion, such as with screws, rivets, adhesive, welding, or the like (none of which is shown). An end plate 132 is affixed to the first end 122 of housing 104 such as with screws 134.

Figure 3:
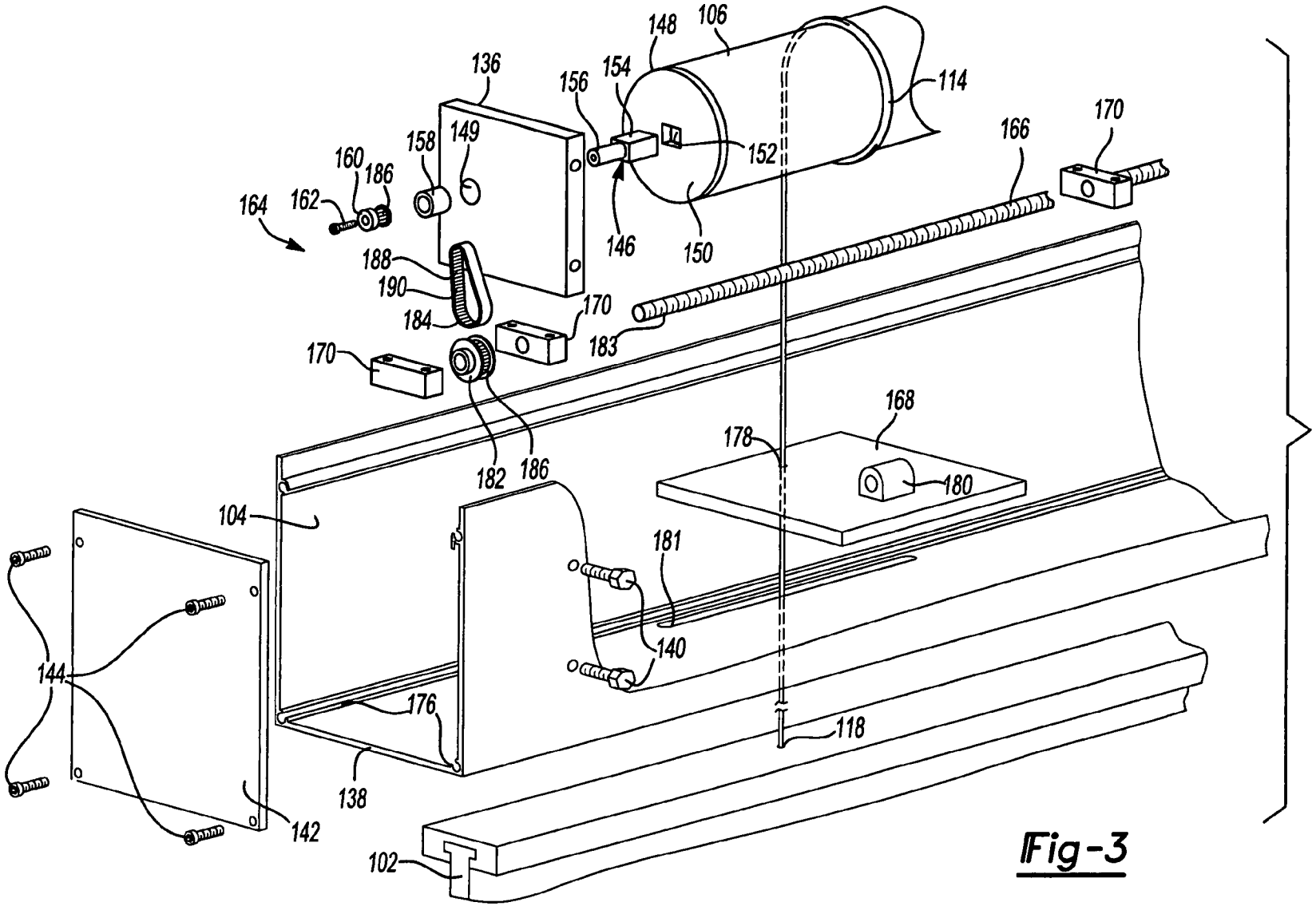
FIG. 3 is a partial exploded view of a first end of the apparatus of FIG. 1.

With specific reference to FIG. 3, apparatus 100 further includes a second mounting bracket 136 mounted in housing 104 at a second end 138 (FIG. 2) of housing 104, such as with screws 140. An end plate 142 is affixed to the second end 138 of housing 104 such as with screws 144. Tube 106 includes a drive shaft 146 that extends from a second end 148 of tube 106 through a hole 149 in second mounting bracket 136. In this regard, tube 106 may include an end cap 150 affixed to its second end 148 to which drive shaft 146 is affixed, such as by being received and secured in a rectangular hole 152 in end cap 150. In this illustrative embodiment, a first end 154 of drive shaft 146 is rectangular and received in hole 152 and a second end 156 of drive shaft 146, that extends through hole 149 in mounting bracket 136, is cylindrical. A bearing 158 may be received in hole 149 and second end 156 of drive shaft 146 entrained in bearing 158. Second end 156 of drive shaft 146 has a drive wheel 160 secured to it, such as by a screw 162.

Apparatus 100 further includes cable indexer 164 (FIG. 2) that includes lead screw 166 and traveler(s) 168. A traveler as used herein is an element that moves along housing 104 along an axis parallel to a longitudinal axis of tube 106. Lead screw 166 is journalled for rotation in support bearings 170 that are disposed along a bottom wall 172 of housing 104. Apparatus 100 illustratively has a traveler 168 for each cable 114 attached to display article 102. It should be understood, however, that traveler cable indexer 164 could have a single traveler 168 that works with multiple cables 114.

Each traveler 168 is entrained for movement along bottom wall 172 of housing 104. Illustratively traveler 168 comprises a flat rectangular block. It should be understood that structures other than blocks can be used for traveler 168. Housing 104 may include opposed tracks 176 (FIG. 3) in which travelers 168 are entrained. Each traveler 168 further includes an aperture 178 therein at one side thereof through which a respective one of cables 114 passes and a threaded member 180, such as a nut, in which lead screw 166 is threadably received. While aperture 178 is shown a hole extending through traveler 168, it should be understood that traveler 168 could include elements affixed to it, such as opposed fingers, that define aperture 178 or in which aperture 178 is formed. Each traveler 168 is disposed in housing 104 so that its aperture 178 is disposed above a slot 181 in bottom wall 172 of housing 104.

Lead screw 166 has a driven wheel 182 secured at an end 183 beneath the drive wheel 160 that is secured to drive shaft 146. A belt 184 is entrained on wheels 160 and 182. In the embodiment shown, wheels 160, 182 have teeth 186 (FIG. 3) around their periphery and belt 184 has corresponding teeth 188 disposed around an inner side 190 that mate with teeth 186 on wheels 160, 182. It should be understood that other arrangements can be used to couple drive shaft 146 to lead screw 166, such as gears and a chain, a gear train, or the like. In this regard, lead screw 166 is synchronously coupled to tube 106 so that there is no slippage between tube 106 and lead screw 166 when tube 106 rotates to drive lead screw 166 as described below. In the illustrative embodiment described, this synchronization is accomplished by mechanically linking drive shaft 146 to lead screw 166, such as with toothed wheels 160, 182 and toothed belt 184. It should be understood that tube 106 and lead screw 166 could be synchronized in other ways. By way of example and not of limitation, stepper motors could be used to drive both tube 106 and lead screw 166 and the stepper motors electrically synchronized.

Figure 8:
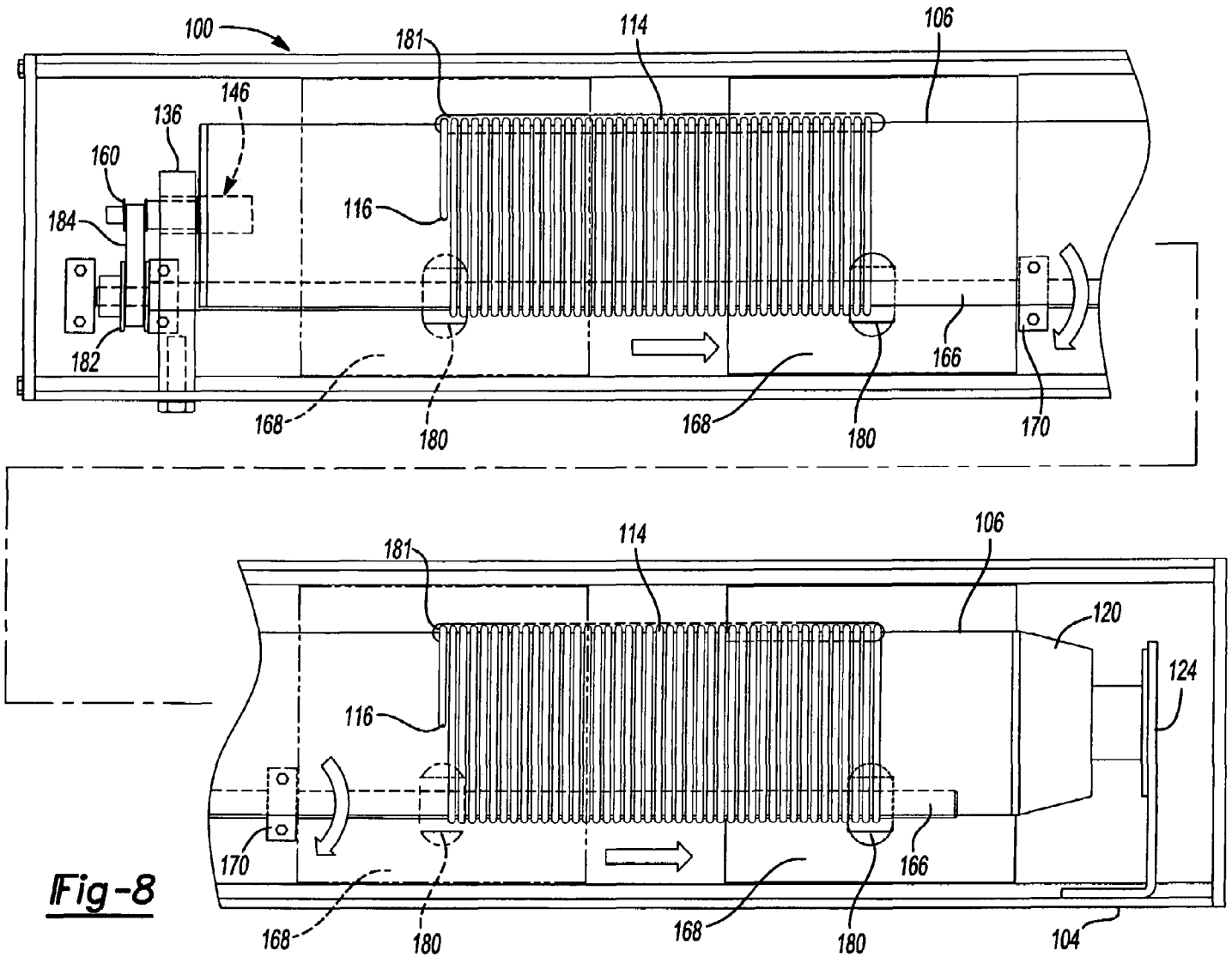
FIG. 8 is another top perspective view of the apparatus of FIG. 1.

In operation, apparatus 100 raises and lowers display article 102 by winding and unwinding cable(s) 114 on tube 106. Motor 120 rotates tube 106 in the appropriate direction to wind and unwind cable(s) 114 on tube 106. As tube 106 rotates, drive shaft 146 drives lead screw 166 via wheels 160, 182 and belt 184 to rotate lead screw 166. The rotation of lead screw 166 in threaded members 180 of travelers 168 of cable indexer 164 causes travelers 168 to travel longitudinally along the bottom wall 172 of housing 104 and thus longitudinally along tube 106. As cables 114 extend through slots 181 in bottom wall 172 of housing 104 and through apertures 178 of travelers 168 of cable indexer 164, each cable 114 is moved longitudinally along tube 106 as it is being wound on tube 106. This evenly winds each cable 114 on tube 106, as shown in FIG. 8 by travelers 168 moving between the position shown in phantom and the position shown in solid. Thus, each cable 114 is wound on tube 106 uniformly with respect to each other cable 114 so that the same length of each cable 114 is wound on tube 106. In the illustrative preferred embodiment, each cable 114 is wound on tube 106 so that there is only one layer of each cable 114 on tube 106 when the display article is in the fully raised position. It should be understood, however, that cable indexer 164 could be configured to reciprocally move cables 114 back and forth as tube 106 rotates in one direction in which case each cable 114 would be wound on itself as it is wound on tube 106, but in even layers so that the cables 114 are wound on the tube 106 uniformly with respect to each other. By winding each cable 114 along tube 106 with cable indexer 164 in such a uniform fashion, the display article 102 is raised so that it will be level when it reaches the raised position. That is, both sides of display article 102 will be at the same height (assuming that apparatus 100 was mounted so that it is level).

Figure 9:
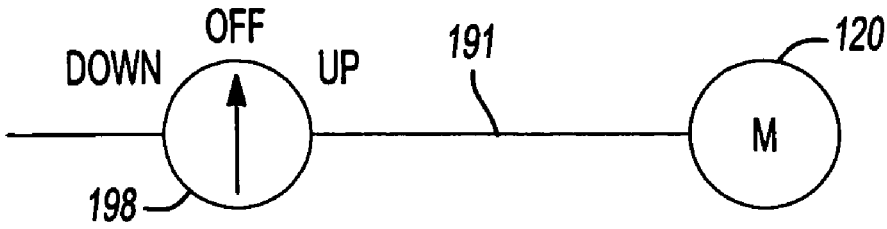
FIG. 9 is a simplified schematic of a switch controlling the motor of the apparatus of FIG. 1.
Figure 10:
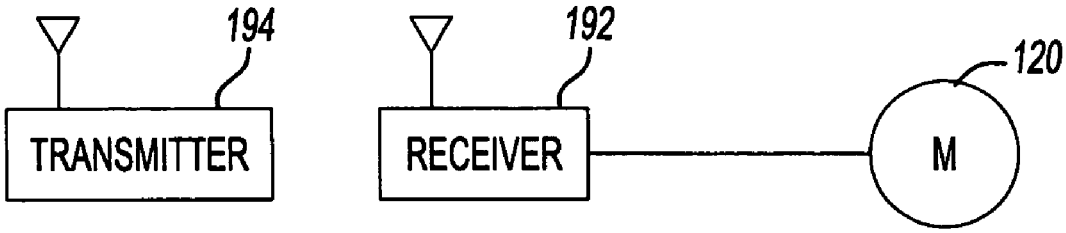
FIG. 10 is a simplified schematic of a remote control receiver controlling the motor of the apparatus of FIG. 1 in response to commands from a remote control transmitter.
Figure 11:
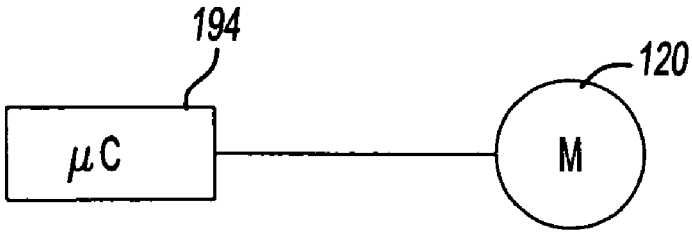
FIG. 11 is a simplified schematic of a programmable device controlling the motor of the apparatus of FIG. 1.

Motor 120 may illustratively be powered by any conventional power source, such as AC, battery or solar panels. Motor 120 may illustratively be turned off by a conventional mechanical switch 198 (FIG. 9), such as may be disposed in the power cord 191 connecting motor 120 to a power source. Apparatus 100 may alternatively or additionally include a remote control receiver 192 (FIG. 10) coupled to motor 120. A user then uses a corresponding transmitter 194 to communicate with the remote control receiver to cause it to energize and de-energize motor 120 in the appropriate directions to wind and unwind cable(s) 114 to raise and lower display article 102. Apparatus 100 may also include a programmable control device 196 (FIG. 11), such as a microcomputer, that is programmed to control motor 120, such as by having pre-sets programmed therein to raise and lower the display article 102 semi-automatically to desired height(s).

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An apparatus for raising and lowering an article, comprising:

a. a tube;

b. a motor coupled to the tube for rotating the tube;

c. a plurality of cables secured to the tube and to the article in spaced relation to each other, the plurality of cables being wound on the tube to raise the article when the tube is rotated in one direction and are unwound from the tube to lower the article when the tube is rotated in an opposite direction; and d. a cable indexer synchronously coupled with the tube for indexing the plurality of cables along the tube as the plurality of cables are wound on the tube to wind the plurality of cables on the tube uniformly with respect to each other and in spaced relation to each other where the cables are wound on the tube at locations spaced from each other.

2. The apparatus of claim 1 wherein the cable indexer includes a traveler having an aperture for each of the plurality of cables, each of the plurality of cables extending through a respective one of the apertures, the traveler mounted in spaced relation to the tube for movement along an axis parallel to a longitudinal axis of the tube as the tube rotates to move each of the plurality of cables longitudinally along the tube as the tube rotates.

3. The apparatus of claim 2 including a lead screw mounted in spaced relation to the tube and synchronously coupled to the tube for rotation synchronously with the tube as the tube rotates, the traveler including a threaded member through which the lead screw is threadably received.

4. The apparatus of claim 3 wherein the cable indexer includes a traveler for each of the plurality of cables.

5. The apparatus of claim 3 including a drive wheel having teeth thereon affixed to the tube, a driven wheel having teeth thereon affixed to the lead screw, and a belt having teeth on an inner surface entrained on the drive wheel and driven wheel, the drive wheel, driven wheel and belt synchronously coupling the lead screw to the tube.

6. The apparatus of claim 2 wherein the traveler moves in one direction along the tube to wind one layer of the cables on the tube when the cables are being wound on the tube and in a second direction opposite the first direction to unwind the cables from the tube.

7. The apparatus of claim 1 including a housing in which the tube on which the cables are wound, the motor and the cable indexer are disposed.

8. The apparatus of claim 1 wherein the motor is a tubular motor having a motor with a tube extending therefrom that is received within the tube on which the cables are wound.

9. The apparatus of claim 1 including a remote control receiver coupled to the motor for controlling operation of the motor in response to signals received from a remote control transmitter.

10. The apparatus of claim 1 including a programmable device coupled to the motor that controls operation of the motor in response to its programming.

11. An apparatus for raising and lowering an article, comprising:

a. a housing in which a tube is rotatably mounted;

b. a motor coupled to the tube for rotating the tube;

c. a plurality of cables secured to the tube and to the article in spaced relation to each other;

d. a cable indexer mounted within the housing that is synchronously coupled with the tube for indexing the plurality of cables along the tube as the plurality of cables are wound on the tube to wind the plurality of cables on the tube so that the cables are wound on the tube uniformly with respect to each other, the cable indexer including a lead screw mounted along a bottom wall of the housing in spaced relation to the tube and synchronously coupled to the tube, the cable indexer also including a traveler for each cable, each traveler disposed along the bottom wall of the housing for movement therealong, each traveler including a threaded member through which the lead screw is threadably received and an aperture through which one of the plurality of cables passes wherein rotation of the tube synchronously rotates the lead screw to move the travelers longitudinally along the housing thus moving the cables longitudinally along the tube as they are wound on the tube.

12. The apparatus of claim 11 including a drive wheel having teeth thereon affixed to the tube, a driven wheel having teeth thereon affixed to the lead screw, and a belt having teeth on an inner surface entrained on the drive wheel and driven wheel, the drive wheel, driven wheel and belt synchronously coupling the lead screw to the tube.

13. The apparatus of claim 11 wherein the motor is a tubular motor having a motor with a tube extending therefrom that is received within the tube on which the cables are wound.

14. The apparatus of claim 11 wherein each traveler moves in one direction along the tube to wind one layer of the cables on the tube when the cables are being wound on the tube and in a second direction opposite the first direction to unwind the cables from the tube.

* * * * *